US008505312B2

(12) United States Patent
Mak et al.

(10) Patent No.: US 8,505,312 B2
(45) Date of Patent: Aug. 13, 2013

(54) LIQUID NATURAL GAS FRACTIONATION AND REGASIFICATION PLANT

(75) Inventors: John Mak, Santa Ana, CA (US); Richard B. Nielsen, Laguna Niguel, CA (US); Curt Graham, Mission Viejo, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 1070 days.

(21) Appl. No.: 10/578,122

(22) PCT Filed: Jun. 17, 2004

(86) PCT No.: PCT/US2004/019490

§ 371 (c)(1), (2), (4) Date: Feb. 7, 2007

(87) PCT Pub. No.: WO2005/045337

PCT Pub. Date: May 19, 2005

(65) Prior Publication Data

US 2007/0125122 A1 Jun. 7, 2007

Related U.S. Application Data

(60) Provisional application No. 60/517,298, filed on Nov. 3, 2003, provisional application No. 60/525,416, filed on Nov. 25, 2003.

(51) Int. Cl.

| | |
|---|---|
| ***F17C 9/02*** | (2006.01) |
| ***F25J 1/00*** | (2006.01) |
| ***F25J 3/00*** | (2006.01) |

(52) U.S. Cl.

USPC ..... 62/50.2; 62/613; 62/620

(58) Field of Classification Search

USPC ..... 62/50.2, 620, 613

See application file for complete search history.

(56) References Cited

U.S. PATENT DOCUMENTS

| | | | | | |
|---|---|---|---|---|---|
| 2,230,619 | A | * | 2/1941 | Katz | 62/620 |
| 2,535,364 | A | * | 12/1950 | Lee | 62/7 |
| 3,195,316 | A | * | 7/1965 | Maher et al. | 62/48.2 |
| 3,303,660 | A | * | 2/1967 | Berg | 62/48.2 |
| 3,663,644 | A | * | 5/1972 | Harvey | 585/634 |
| 3,857,245 | A | * | 12/1974 | Jones | 60/651 |
| 6,089,022 | A | * | 7/2000 | Zednik et al. | 60/641.7 |
| 6,089,028 | A | * | 7/2000 | Bowen et al. | 62/50.2 |
| 6,460,350 | B2 | | 10/2002 | Johnson et al. | |
| 6,598,564 | B2 | * | 7/2003 | Gerstendorfer et al. | 122/448.1 |
| 6,604,380 | B1 | * | 8/2003 | Reddick et al. | 62/620 |
| 6,640,556 | B2 | | 11/2003 | Ursan et al. | |
| 6,688,114 | B2 | * | 2/2004 | Nierenberg | 62/50.2 |
| 6,745,576 | B1 | | 6/2004 | Granger | |
| 7,155,931 | B2 | * | 1/2007 | Wilkinson et al. | 62/620 |
| 2003/0029190 | A1 | * | 2/2003 | Trebble | 62/620 |
| 2003/0158458 | A1 | | 8/2003 | Prim | |

FOREIGN PATENT DOCUMENTS

| | | | |
|---|---|---|---|
| JP | 57164183 A | * | 10/1982 |
| JP | 01768584 | | 5/1995 |

* cited by examiner

*Primary Examiner* — Judy Swann
*Assistant Examiner* — Filip Zec
(74) *Attorney, Agent, or Firm* — Fish & Associates, PC

(57) ABSTRACT

LNG vapor from an LNG storage vessel is absorbed using $C_3$ and heavier components provided by a fractionator that receives a mixture of LNG vapors and the $C_3$ and heavier components as fractionator feed. In such configurations, refrigeration content of the LNG liquid from the LNG storage vessel is advantageously used to condense the LNG vapor after separation. Where desired, a portion of the LNG liquid may also be used as fractionator feed to produce LPG as a bottom product.

18 Claims, 4 Drawing Sheets

LIQUID NATURAL GAS FRACTIONATION AND REGASIFICATION PLANT

This application claims the benefit of U.S. provisional patent applications with the Ser. Nos. 60/517,298 (filed Nov. 3, 2003) and 60/525,416, (filed Nov. 25, 2003), both of which are incorporated by reference herein.

FIELD OF THE INVENTION

The field of the invention is LNG processing, especially as it relates to LNG vapor handling during LNG ship unloading or transfer.

BACKGROUND OF THE INVENTION

LNG ship unloading is in many cases a critical operation that requires efficient integration with a regasification operation. Typically, when LNG is unloaded from an LNG ship to a storage tank, LNG vapors are generated from the storage tank due to volumetric displacement, heat gain during LNG transfer and in the pumping system, storage tank boiloff, and flashing due to the pressure differential between the ship and the storage tank. In most cases, the vapors need to be recovered to avoid flaring and pressure buildup in the storage tank system.

In a typical LNG receiving terminal, a portion of the vapor is returned to the LNG ship, while the remaining vapor portion is compressed by a compressor for condensation in a vapor absorber that uses the refrigeration content from the LNG sendout. Therefore, vapor compression and vapor absorption systems generally require significant energy and operator attention, and particularly during transition from normal holding operation to ship unloading operation. Alternatively, vapor control can be implemented using a reciprocating pump in which the flow rate and vapor pressure control the proportion of cryogenic liquid and vapor supplied to the pump as described in U.S. Pat. No. 6,640,556 to Ursan et al. However, such configurations are often impractical and generally fail to eliminate the need for vapor recompression in LNG receiving terminals.

Alternatively, or additionally, a turboexpander-driven compressor may be employed as described in U.S. Pat. No. 6,460,350 to Johnson et al. Here the energy requirement for vapor recompression is typically provided by expansion of a compressed gas from another source. However, where a compressed gas is not readily available from another process, generation of the compressed gas is energy intensive and uneconomical.

In other known systems, methane product vapor is compressed and condensed against an incoming LNG stream as described in published U.S. patent application to Prim with the publication number 2003/0158458. While Prim's system increases the energy efficiency as compared to other systems, various disadvantages nevertheless remain. For example, vapor handling in Prim's system is typically limited to plants in which production of a methane rich stream is desired.

In yet another system, as described in U.S. Pat. No. 6,745,576, a plurality of mixers, collectors, pumps, and compressors are used for re-liquefying boil-off gas in an LNG stream. In this system, the atmospheric boil-off vapor is compressed to a higher pressure using a vapor compressor such that the boil-off vapor can be condensed. While such a system typically provides improvements of control and mixing devices in a vapor condensation system, it nevertheless inherits most of the disadvantages of known configurations as shown in Prior Art FIG. 1.

Moreover, the composition and heating values of most imported LNG varies dramatically and will generally depend on the particular source. While LNG with heavier contents or higher heating value can be produced at lower costs at the source, they are often not suitable for the North American market. For example, natural gas for the Californian market must meet a heating value specification of 950 Btu/SCF-1150 Btu/SCF, and must meet composition limitations on its $C_2$ and $C_3$+ components. Especially where LNG is used as transportation fuel, the $C_2$+ content must be further reduced to avoid high combustion temperature and reduce greenhouse emissions. Table 1 below depicts composition requirements in comparison to a typical imported LNG supply. Thus, it would also be desirable to configure an LNG receiving terminal with the capability to accommodate to varying LNG compositions.

TABLE 1

| COMPONENT | NATURAL GAS SPEC. | TYPICAL LNG SUPPLY |
|---|---|---|
| $C_1$ | 88% minimum | 87% to 94% |
| $C_2$ | 6% maximum | 3% to 7% |
| $C_3$-$C_5$ | 3% maximum | 1% to 7% |
| $C_6$+ | 0.2% maximum | 0.1% to 0.8% |
| $N_2$ | 1.4 to 4.5% | Less than 0.1% |
| Gross Heating Value, Btu/SCF | 970-1150 | 1050-1200 |

Unfortunately, most of the currently known processes and configurations for LNG ship unloading and regasification fail to address various difficulties. Among other things, many of the known processes require vapor compression and absorption that are energy inefficient. Still further all or almost all of the known processes fail to economically remove heavy hydrocarbons from LNG to meet stringent environmental standards. Thus, there is still a need to provide improved configurations and methods for gas processing in LNG unloading and regasification terminals.

SUMMARY OF THE INVENTION

The present invention is directed to various configurations and methods for an LNG plant (most preferably to an LNG regasification terminal) comprising an LNG storage vessel and fractionator configured to receive liquefied natural gas from an LNG carrier vessel and to provide LNG liquid and LNG vapor. A fractionator is fluidly coupled to the storage vessel and receives a fractionator feed, wherein the fractionator produces $C_2$ and lighter components as an overhead product and $C_3$ and heavier components as a bottom product. In preferred configurations, the refrigeration content of the liquefied natural gas liquid is used to condense the $C_2$ and lighter components, while the $C_3$ and heavier components are combined with the LNG vapor to absorb the LNG vapor to thereby form the fractionator feed.

In further preferred aspects of the inventive subject matter, contemplated plants include a first heat exchanger to cool the fractionator feed using the liquefied natural gas liquid as a refrigerant, and/or a second heat exchanger that heats the fractionator feed using the stream of $C_3$ and heavier components from the fractionator as a heat source. In still further contemplated plants, a portion of the LNG vapor from the storage vessel is routed to a second LNG storage vessel (LNG carrier), or the second LNG storage vessel may produce a vapor that is rerouted back to the second LNG storage vessel during ship unloading.

Preferred fractionators are typically configured to provide the condensed $C_2$ and lighter components to the liquefied natural gas liquid. Alternatively, or additionally, the fractionator may also be configured to receive a portion of the liquefied natural gas liquid as fractionator feed (after the liquefied natural gas liquid has provided refrigeration for condensation of the $C_2$ and lighter components).

Moreover, in yet further contemplated aspects, the fractionator may further be configured to provide liquefied petroleum gas (LPG) as a bottom product. In such configurations, the fractionator may be configured to receive another portion of the liquefied natural gas liquid as condensation refrigerant after the liquefied natural gas liquid provided refrigeration for condensation of the $C_2$ and lighter components to enhance condensation.

Thus, contemplated methods include methods of handling liquefied natural gas vapor in which a liquefied natural gas storage vessel provides LNG liquid and LNG vapor. In another step, the LNG vapor is combined with a stream of $C_3$ and heavier components to thereby absorb the LNG vapor and to thereby form a combined product. In yet another step, the combined product is separated in a fractionator into the stream of $C_3$ and heavier components and a stream of $C_2$ and lighter components, and the stream of $C_2$ and lighter components is condensed using the refrigeration content of the LNG liquid.

Various objects, features, aspects and advantages of the present invention will become more apparent from the accompanying drawings and detailed description of preferred embodiments of the invention.

DETAILED DESCRIPTION

The present invention is generally directed to configurations and methods of LNG vapor handling in which the vapor (in most cases predominantly comprising $N_2$, $C_1$ and $C_2$) is combined with a heavier hydrocarbon (in most cases predominantly comprising $C_3$, $C_4$ and heavier components) to form a hydrocarbon mixture having a condensation temperature that is higher than that of the LNG vapor. The so generated mixture is subsequently condensed using the refrigeration content of the LNG liquid and the liquid is pumped to a higher pressure. The pressurized mixture is then heated, and ($C_2$ and lighter) vapor is separated from the mixture in a fractionator at elevated pressure. The fractionator overhead vapor is condensed using the refrigeration content of the LNG liquid, while the heavier hydrocarbon produced by the fractionator is recycled to the point of combination with LNG vapor.

In a particularly preferred aspect of the inventive subject matter, contemplated configurations and methods are realized in LNG ship unloading and/or regasification operation in both on-shore and/or off-shore LNG regasification terminals. It should be especially appreciated that in such configurations the need for a vapor compressor for condensation of the vapors is eliminated by mixing the vapor with a component that increases the boiling point of the mixture to a degree such that at least a portion of the mixture can be condensed using the refrigeration content of the LNG liquid.

Preferably, the heavier hydrocarbon comprises $C_3$ and heavier hydrocarbon components that may be added from an external source, or even more preferably, that are extracted from the LNG that is unloaded. Thus, and at least in some aspects of the inventive subject matter, contemplated configurations include a fractionation system comprising heat exchangers, pumps and fractionators that is configured to utilize the refrigeration released in the regasification process for the separation of LNG into a leaner natural gas and a LPG (Liquefied Petroleum Gas) product. Further contemplated configurations and methods for regasification of LNG that may be used in conjunction with the teachings presented herein are described in our copending International patent application number with the serial number PCT/US03/25372, filed Aug. 13, 2003, and which is incorporated herein by reference.

Figure 1:
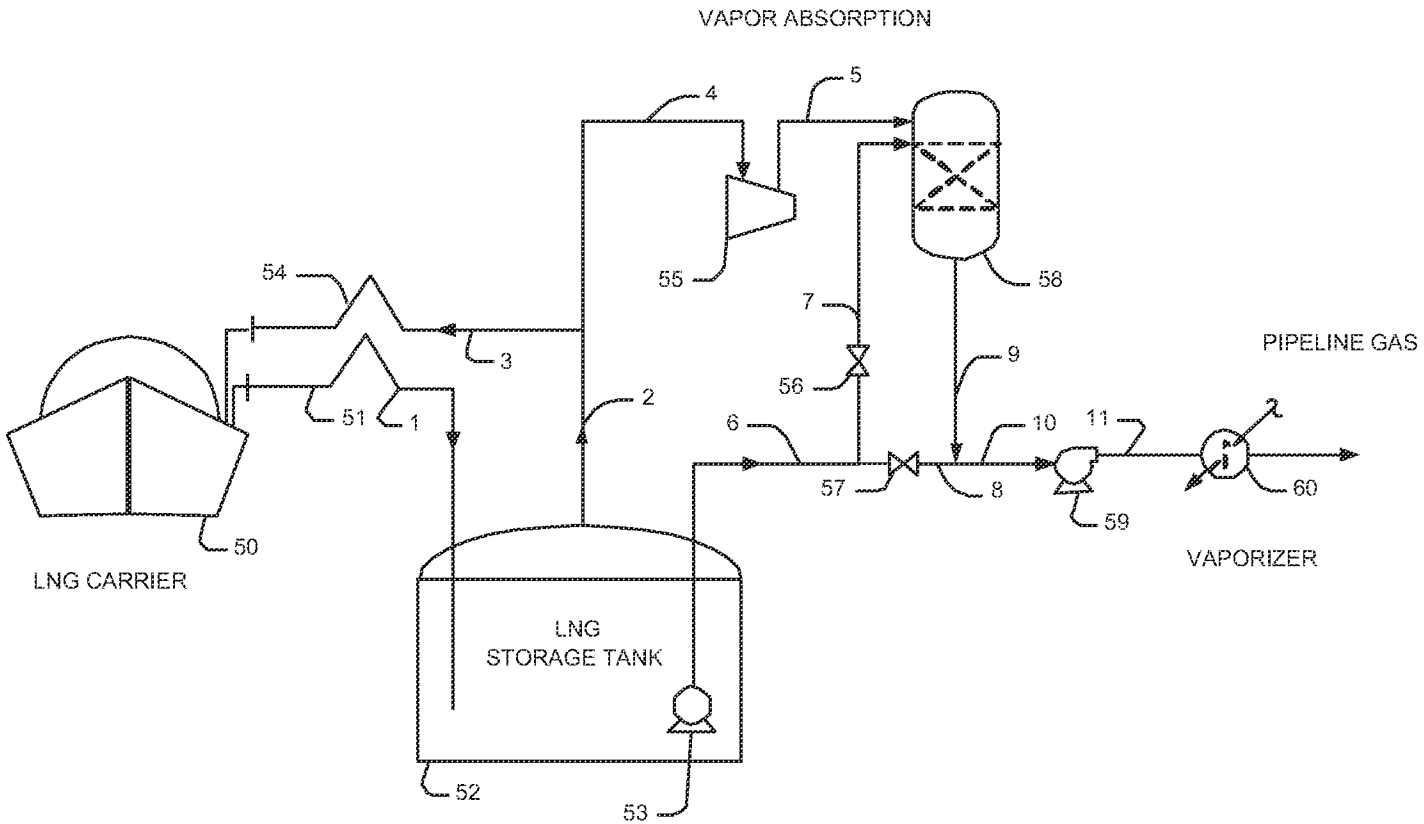
Figure 1 (Prior Art)
FIG. 1 is a Prior Art schematic of an LNG unloading configuration.

Configurations and methods of the inventive subject matter are contrasted with a conventional LNG carrier unloading and regasification terminal schematically depicted in Prior Art FIG. 1. Here, LNG typically at −255° F. to −260° F. is unloaded from a LNG carrier ship 50 via unloading arm 51, the transfer line 1 into storage tank 52, typically at a flow rate of 40,000 GPM to 60,000 GPM. The unloading operation generally lasts for about 12 to 16 hours, and during this period, about 40 MMscfd of vapor is generated from the storage tank, as a result from the enthalpy gain (either by the ship pumps or heat gain from the surroundings) during the transfer operation, the displacement vapor from the storage tanks, and the liquid flashing from the pressure difference between the ship and the storage tank.

An LNG carrier ship typically operates at a pressure slightly less than that of the storage tank, and typically, the LNG ship operates at 16.2 psia to 16.7 psia while the storage tank operates at 16.5 psia to 17.2 psia. The vapor from the storage tank, stream 2, is split into two portions, stream 3 and stream 4. Stream 3 typically at a flow rate of 20 MMscfd is returned to the LNG ship via a vapor return line and return arm 54 for replenishing the displaced volume from ship unloading. Stream 4, typically at a flow rate of 20 MMscfd, is compressed by compressor 55 to about 80 psia to 115 psia and fed as stream 5 to the vapor absorber 58 where the vapor is de-superheated, condensed and absorbed from stream 9 by the sendout LNG. The power consumption by compressor 55 is typically 1,000 HP to 2,000 HP, depending on the vapor flow rate and compressor discharge pressure.

LNG from the storage tank 52 is pumped by the in-tank primary pumps 53 to about 115 to 150 psia forming stream 6, at a typical sendout rate of 250 MMscfd to 1,200 MMscfd. Stream 6 is split into stream 7 and stream 8 using the respective control valves 56 and 57, as needed for controlling the vapor condensation process. Stream 7, a subcooled liquid at −255° F. to −260° F., is routed to the absorber 58 to mix with the compressor discharge stream 5 using a heat transfer contacting device such as trays and packing. The operating pressures of the vapor absorber and the compressor are determined by the LNG sendout flow rate. A higher LNG sendout rate with a higher refrigeration content would lower the absorber pressure, and hence require a smaller compressor. However, the absorber design should also consider the normal holding operation when the vapor rate is lower, and the liquid rate must be reduced to a minimal.

The vapor absorber produces a bottom stream 9 typically at about −200° F. to −220° F., which is then mixed with stream 8 forming streaming 10. Stream 10 is pumped by the secondary pump 59 to typically 1000 psig to 1500 psig forming stream 11 which is then heated in LNG vaporizers 60 to about 40° F. to 60° F. as needed to meet the pipeline specifications. The LNG vaporizers are typically open rack type exchangers using seawater, fuel-fired vaporizers, or vaporizers using a heat transfer fluid.

Figure 2:
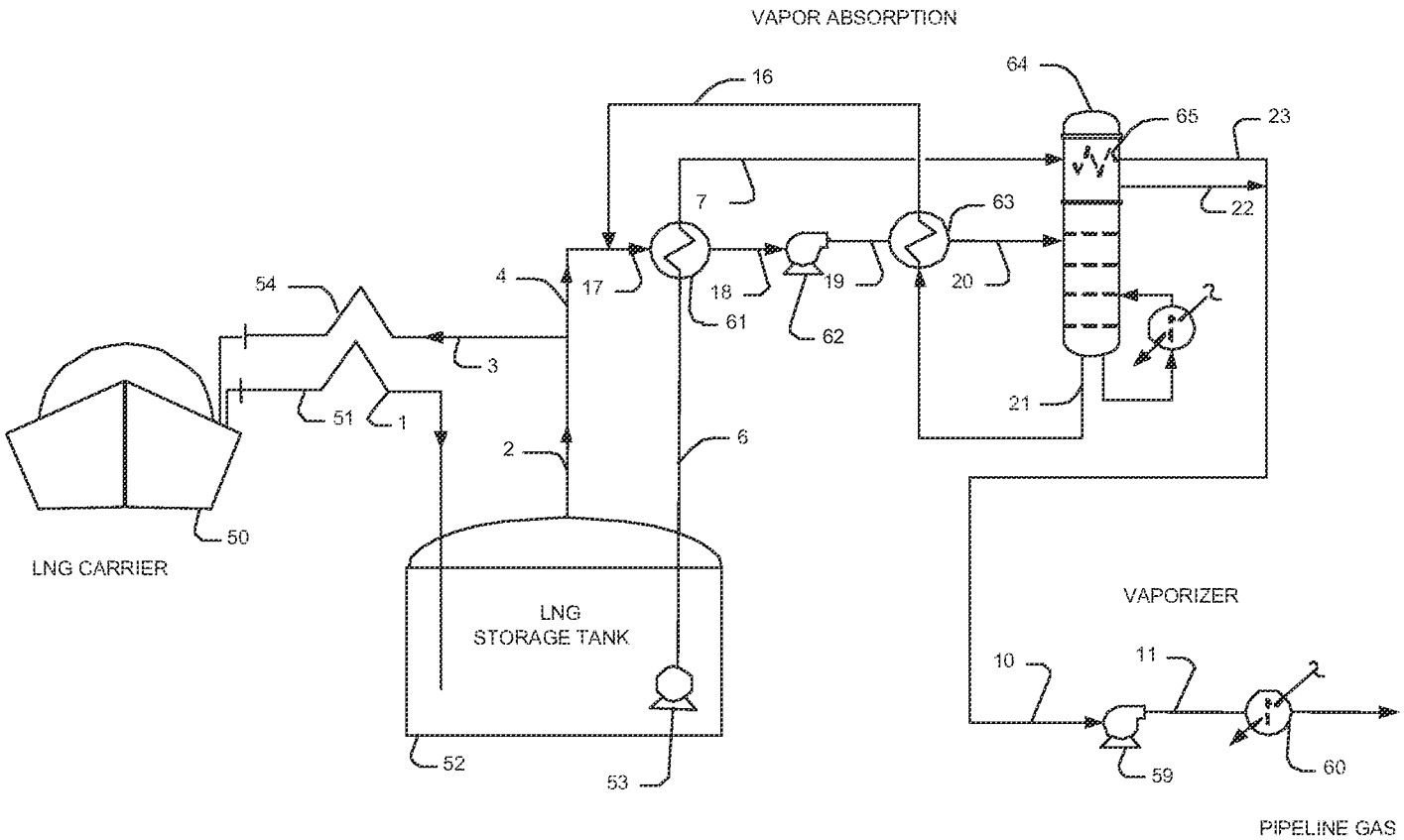
FIG. 2 is a schematic of an exemplary LNG unloading configuration with an external vapor return line.

In contrast, the inventors discovered configurations and methods in which LNG ship unloading is operationally coupled to an LNG regasification/processing plant and in which LNG vapor handling process and efficiency is significantly improved. Among other advantages, contemplated configurations and methods eliminate the need for vapor recompression and therefore substantially decrease capital and energy requirements. An exemplary configuration is depicted in FIG. 2 in which vapor absorption is carried out at storage tank overhead pressure using a heavy hydrocarbon liquid (e.g., $C_3$ and heavier) for absorption, with the heavy hydrocarbon separated from LNG using a fractionator. The refrigeration content in the LNG is used for cooling in the absorption process by removing the heat of absorption and condensation as well as in supplying the reflux condensing duty in the fractionator. As the mixture of the vapors and the heavy hydrocarbon liquid condenses at significantly higher temperature, it should be recognized that a compressor and vapor absorber as depicted in prior art FIG. 1 are no longer required. Instead, these elements are replaced by a low pressure condenser exchanger and pumping system, which are installed and operated at significantly reduced cost.

Viewed from another perspective, it should be recognized that in contemplated configurations the composition of the vapors from the storage tank is modified by mixing these vapors with a subcooled heavy hydrocarbon stream (the addition of heavy hydrocarbons increases the boiling point temperature, and therefore allows condensation of the mixture with LNG). This mixture is pumped to and separated in a downstream fractionator for recovery and/or recycling of the heavier hydrocarbons.

With further reference to FIG. 2, LNG liquid as stream 1 is provided from the LNG carrier ship 50 to the storage tank 52 via unloading line 51. Vapor stream 2 from storage tank 52 is split into stream 3 and stream 4. Stream 3, typically at a flow rate of 20 MMscfd, is returned to the LNG carrier ship 50 via a vapor return line and return arm 54 for replenishing the displaced volume from ship unloading. Stream 4, typically at a flow rate of 20 MMscfd, is mixed with the heavy hydrocarbon stream 16 (typically containing $C_3$, $C_4$, and heavier hydrocarbons). To raise the boiling point of the mixture, typically about 200 GPM to 500 GPM heavy hydrocarbons is required from the downstream fractionation system. Where the heavy hydrocarbon fraction is not available from the LNG source for raising the boiling temperature and condensation of the mixture stream 17, the system may be charged with the heavy hydrocarbons from an external source. The combined stream 17 is cooled and condensed in exchanger 61 to stream 18 using the refrigeration content from the LNG stream 6 (provided from tank 52 via primary pump 53) typically at −240° F. to −255° F.

It should be appreciated that the heavy hydrocarbon composition and flow rate of the heavy hydrocarbon fraction can be controlled in the fractionator as necessary to absorb the vapors from the storage tank during the ship unloading and the normal holding operation. For example, a LNG vapor rich in the lighter components such as $N_2$ and $C_1$, will proportionally require more LNG flow and heavier components for absorption and condensation. Therefore, flow rates of less than 200 gpm and higher than 500 gpm are also deemed suitable. A person of ordinary skill in the art will readily determine suitable flow rates, which will predominantly depend on the amount of vapor and the composition of the heavy hydrocarbon.

Moreover, it should be recognized that the components selection of the hydrocarbon is not critical so long as the hydrocarbon will increase the boiling point temperature to a degree sufficient to allow condensation of the combined stream using the refrigeration content of the LNG liquid. Therefore, suitable components for admixture with the vapor stream especially include propane, butane, and higher hydrocarbons.

In exchanger 61, stream 6 is heated from −255° F. to about −240° F. and supplies the necessary cooling for condensing the combined stream 17. The condensate stream 18 is then pumped by pump 62 to about 120 psia to 170 psia forming stream 19. Prior to feeding stream 19 to the fractionator 64, the pressurized stream 19 is heated to about −10° F. to 150° F. and partially vaporized in exchanger 63 by heat exchange with the bottom liquid 21 from the fractionator 64 to thereby form heated stream 20. The fractionator 64, typically operating at about 100 psia to 150 psia, separates the heated combined stream 20 into an overhead liquid stream 22 (containing mostly $C_2$ and lighter components) and bottom liquid stream 21 (containing mostly $C_3$ and heavier components). The fractionator is refluxed using the refrigeration content from LNG stream 7 in an overhead condenser 65 (which can be separate or integral to fractionator 64). Where desirable, overhead condenser 65 can also be located external to the fractionator, and the liquid stream 22 can be separated in an external located drum (not shown). The fractionator is preferably reboiled using an external heat source with a fired reboiler, steam, or other heat source.

The overhead stream 22, which is depleted of the heavy hydrocarbons ($C_3$ and heavier) is mixed with the LNG stream 23 forming stream 10. The combined sendout stream 10 is then pumped by the secondary pump 59 to typically 1000 psig to 1500 psig forming stream 11, which is then heated in LNG vaporizers 60 to about 40° F. to 60° F. as needed to meet the pipeline specifications. The LNG vaporizers are typically open rack type exchangers using seawater, fuel-fired vaporizers, or vaporizers using a heat transfer fluid.

Figure 3:
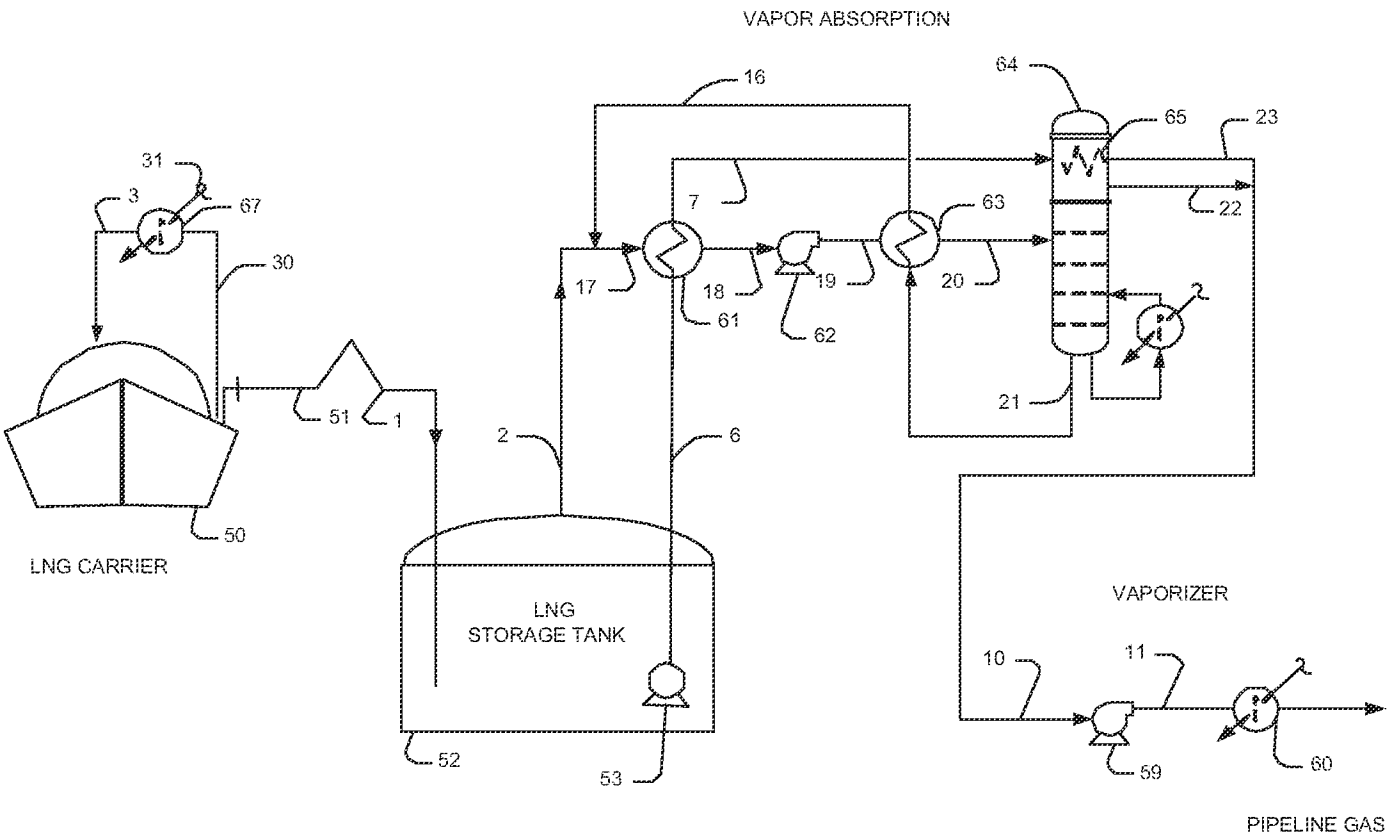
FIG. 3 is a schematic of an exemplary LNG unloading configuration without an external vapor return line.

In another aspect of contemplated configurations, as shown in FIG. 3, vapor from the storage tank 52 is not returned to the LNG carrier ship 50. Consequently, no vapor return line and vapor return arm are needed. Instead, the vapor required by the ship for maintaining volumetric balance is generated with a small vaporizer proximal to or even on the ship. Here, a small stream 30 of LNG liquid is vaporized in the heat exchanger 67 to produce vapor stream 3 to achieve a vapor flow of about 20 MMscfd to replenish the displaced volume from the ship. The heat source 31 to the vaporizer 67 can be seawater or ambient air. Such configurations are thought to result in further significant cost savings in the terminal design, particularly in a facility where there is a relatively large distance between the ship 50 and the storage tank 52. Consequently, the entire vapor stream 2 from the tank is combined with heavy hydrocarbon stream 16, absorbed and condensed with LNG stream 6 under similar conditions as described above. In such configurations, the flow rate of stream 16 is increased correspondingly to about 400 GPM to 1,200 GPM, as needed for the absorption of the higher LNG vapor flow. With respect to the remaining components and numerals in FIG. 3, the same considerations and designations as provided for FIG. 2 above apply.

Figure 4:
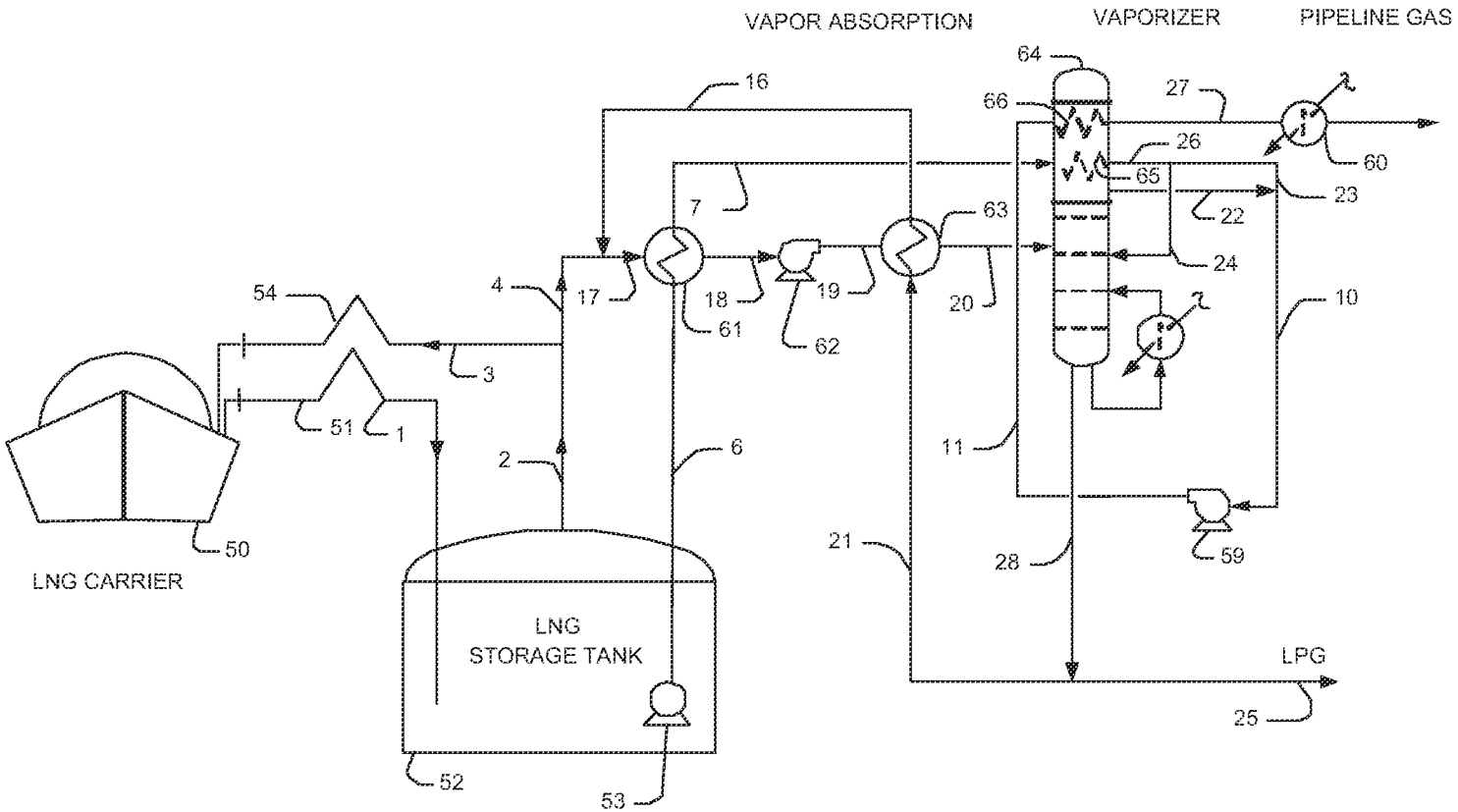
FIG. 4 is a schematic of an exemplary LNG unloading configuration with an external vapor return line and LPG production capability.

In yet another preferred aspect of the inventive subject matter, and especially where it is desired to extract LPG from the crude LNG, or to otherwise modify the chemical composition of the LNG (e.g., to meet environmental regulations or pipeline specifications), additional cooling may be provided to the fractionator as depicted in exemplary configuration of FIG. 4. In such configurations, the overhead condenser 65 of fractionator 64 includes a second refrigeration coil 66 integral to the column that uses the high pressure LNG to provide additional cooling as needed for higher reflux duty required for LPG production. Alternatively, heat exchanger coil 66 and coil 65 can be located external to the column in separate heat exchangers, and liquid stream 22 can be separated in an external drum. Here, the LNG stream 26 exiting the condenser coil 65 at about −220° F. to −240° F. is split into two portions; stream 23 and stream 24. It should be recognized that the exact amount of stream 24 may vary considerably and will predominantly depend on the quality and quantity of the LPG that is desired. Therefore, stream 24 may be between 0 to 100% of stream 26 (increasing stream 24 increases LPG production). With increasing LPG production, it should be recognized that the distillate becomes leaner in composition. Among other desirable effects, a leaner LNG with lower heating value may be more desirable to meet environmental regulations.

Stream 24 is preferably fed to about the mid section of the fractionator that produces a bottom LPG stream 28, and an overhead distillate liquid stream 22 that is depleted of the heavy hydrocarbons. The distillate stream 22 is then mixed with the LNG stream 23 forming stream 10 typically at −220° F. to −230° F. that is further pumped by the secondary pump 59 to about 1,000 psig to 1,400 psig forming stream 11. The high pressure LNG stream is heat exchanged with the overhead vapor in reflux condenser coil 66 forming stream 27, typically at about −180° F. to −200° F. Stream 27 is further heated in vaporizer 60 to meet the pipeline gas requirement. The bottom stream 28 is typically split into two portions; stream 25 and stream 21. Stream 21 is recycled back to exchanger 63 prior to its use for vapor absorption, and remaining stream 25 can be sold as the LPG product. With respect to the remaining components and numerals in FIG. 4, the same considerations and designations as provided for FIG. 2 above apply.

Based on the above exemplary configurations, the inventors contemplate a plant that includes an LNG storage vessel that receives LNG (preferably from a second LNG storage vessel, and most preferably from a LNG carrier ship) and that provide LNG liquid and LNG vapor. A fractionator produces a stream of $C_2$ and lighter components and a stream of $C_3$ and heavier components from a fractionator feed, wherein the refrigeration content of the liquefied natural gas liquid condenses the $C_2$ and lighter components, and wherein the $C_3$ and heavier components absorb the liquefied natural gas vapor thereby forming the fractionator feed.

In especially preferred plant configurations, a first heat exchanger cools the fractionator feed using the liquefied natural gas liquid as a refrigerant to thereby condense the mixture of the LNG vapor and the $C_3$ and heavier components, while a second heat exchanger heats the (preferably pressurized) fractionator feed using the stream of $C_3$ and heavier components from the fractionator as a heat source. In further preferred aspects, the separated and condensed $C_2$ and lighter components are combined with the LNG liquid (after the LNG liquid has been used as refrigerant).

Still further preferred configurations also include those in which the fractionator receives a portion of the liquefied natural gas liquid as fractionator feed (preferably after the liquefied natural gas liquid has provided refrigeration for condensation of the $C_2$ and lighter components), and in which the fractionator is configured to provide liquefied petroleum gas (LPG) as a bottom product. In such configurations, it is further preferred that another portion of the LNG liquid is used as condensation refrigerant after the liquefied natural gas liquid has provided refrigeration for condensation of the $C_2$ and lighter components.

Consequently, the inventors contemplate a method of handling LNG vapor in which LNG liquid and LNG vapor are provided by a LNG storage vessel. In another step, the LNG vapor is combined with a stream of $C_3$ and heavier components to thereby absorb the liquefied natural gas vapor and to thereby form a combined product, and in yet another step, the combined product is separated in a fractionator into the stream of $C_3$ and heavier components and a stream of $C_2$ and lighter components. In still another step, the stream of $C_2$ and lighter components is condensed using refrigeration content of the liquefied natural gas liquid.

Thus, specific embodiments and applications of LNG vapor handling and regasification have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A LNG regasification plant comprising:

a liquefied natural gas storage vessel having a receiving port that is configured to receive liquefied natural gas and further having separate liquid withdrawal and vapor withdrawal ports that are configured to allow separate withdrawal of a liquefied natural gas liquid and a liquefied natural gas vapor from the storage vessel;

a fractionator that is fluidly coupled to the storage vessel and configured to receive a fractionator feed, wherein the fractionator is configured to allow production of (a) an overhead product comprising $C_2$ and lighter components and (b) a bottom product comprising $C_3$ and heavier components;

a first conduit configured to combine the bottom product comprising C3 and heavier components with the liquefied natural gas vapor from the storage vessel to thereby form a two-phase mixture;

a heat exchanger configured to condense the two-phase mixture using refrigeration content of the natural gas liquid to thereby form the fractionator feed; and an overhead condenser coupled to the fractionator and configured to allow refrigeration content of the liquefied natural gas liquid to condense the overhead product comprising $C_2$ and lighter components; and a second conduit configured to combine the condensed overhead product comprising C2 and lighter components with the liquefied natural gas liquid to so produce a sendout stream.

2. The plant of claim 1 wherein a portion of the liquefied natural gas vapor from the storage vessel is routed to a second liquefied natural gas storage vessel.

3. The plant of claim 1 further comprising a second heat exchanger configured to heat the fractionator feed using the bottom product comprising $C_3$ and heavier components from the fractionator as a heat source.

4. The plant of claim 1 wherein the overhead condenser is an internal overhead condenser.

5. The plant of claim 1 further comprising a second liquefied natural gas storage vessel that provides the liquefied natural gas and configured to provide a second liquefied natural gas vapor to the second liquefied natural gas storage vessel.

6. The plant of claim 5 wherein the second liquefied natural gas storage vessel is located on a ship.

7. The plant of claim 1 further comprising a LNG vaporizer that is coupled to the fractionator to receive the sendout stream.

8. The plant of claim 1 wherein the fractionator is further configured to provide a liquefied petroleum gas as a bottom product.

9. The plant of claim 1 wherein the fractionator is configured to receive a portion of the liquefied natural gas liquid as a second fractionator feed after the portion of the liquefied natural gas liquid has provided refrigeration for condensation of the overhead product comprising $C_2$ and lighter components.

10. A method of handling liquefied natural gas vapor in a LNG regasification plant, comprising:

separately and concurrently withdrawing from a liquefied natural gas storage vessel a liquefied natural gas liquid and a liquefied natural gas vapor;

mixing the liquefied natural gas vapor from the storage vessel with a fractionator bottom product comprising C3 and heavier components to thereby form a two-phase mixture, and condensing the two-phase mixture in a heat exchanger using refrigeration content of the natural gas liquid to so form a fractionator feed;

feeding the fractionator feed into a fractionator to thereby form the fractionator bottom product comprising C3 and heavier components and a stream of C2 and lighter components;

withdrawing the condensed stream of $C_2$ and lighter components from the fractionator, then condensing in an overhead condenser the stream of C2 and lighter components using refrigeration content of the liquefied natural gas liquid; and combining the condensed stream of C2 and lighter components with the liquefied natural gas liquid to so produce a sendout stream.

11. The method of claim 10 further comprising a step of using the fractionator bottom product comprising $C_3$ and heavier components from the fractionator to heat the fractionator feed before the fractionator feed is fed to the fractionator.

12. The method of claim 10 further comprising a step of providing a second liquefied natural gas storage vessel that provides the liquefied natural gas to the liquefied natural gas storage vessel.

13. The method of claim 12 wherein the second liquefied natural gas storage vessel receives a portion of the liquefied natural gas vapor.

14. The method of claim 12 wherein the second liquefied natural gas storage vessel is configured to form a stream of liquefied natural gas vapor, and wherein the stream of liquefied natural gas vapor is provided back to the second liquefied natural gas storage vessel.

15. The method of claim 12 wherein the second liquefied natural gas storage vessel is located on a ship.

16. The method of claim 10 further comprising a step feeding a portion of the liquefied natural gas liquid to the fractionator after the liquefied natural gas liquid has provided refrigeration for condensation of the $C_2$ and lighter components.

17. The method of claim 16 wherein the fractionator is configured to provide a liquefied petroleum gas as a bottom product.

18. The method of claim 17 further comprising a step of using a portion of the liquefied natural gas liquid as condensation refrigerant after the liquefied natural gas liquid provided refrigeration for condensation of the $C_2$ and lighter components.

* * * * *